US005212037A

United States Patent [19]

Julien et al.

[11] Patent Number: 5,212,037

[45] Date of Patent: May 18, 1993

[54] TONER PROCESS WITH METAL OXIDES

[75] Inventors: Paul C. Julien; Ronald J. Koch, both of Webster; Grace T. Brewington, Fairport, all of N.Y.

[73] Assignee: Xerox Corporation, Stamford, Conn.

[21] Appl. No.: 739,071

[22] Filed: Aug. 1, 1991

[51] Int. Cl.[5] ..... G03G 9/08; G03G 9/00

[52] U.S. Cl. ..... 430/120; 430/109; 430/110

[58] Field of Search ..... 430/109, 110, 120

[56] References Cited

U.S. PATENT DOCUMENTS

| | | | |
|---|---|---|---|
| 3,888,678 | 6/1975 | Bailey, Jr. et al. | 96/87 A |
| 4,647,522 | 3/1987 | Lu | 430/109 |
| 4,828,951 | 5/1989 | Kaneko et al. | 430/110 |
| 4,837,100 | 6/1989 | Murofushi et al. | 430/106.6 |
| 4,868,600 | 9/1989 | Hays et al. | 355/259 |
| 4,871,616 | 10/1989 | Kimura et al. | 428/407 |
| 4,873,185 | 10/1989 | Uchida et al. | 430/903 |
| 4,933,251 | 6/1990 | Ichimura et al. | 430/109 |
| 4,973,540 | 11/1990 | Machida et al. | 430/110 |

FOREIGN PATENT DOCUMENTS 1062667 3/1989 Japan .

*Primary Examiner*—Marion E. McCamish
*Assistant Examiner*—Stephen Crossan
*Attorney, Agent, or Firm*—John L. Haack; E. O. Palazzo

[57] ABSTRACT

A process for avoiding, or minimizing toner contamination of electrodes in a scavengeless electrophotographic imaging apparatus which comprises adding to the donor roll present in said apparatus a toner comprised of resin, pigment, charge additive, and a metal oxide, or a mixture of metal oxides.

8 Claims, No Drawings

TONER PROCESS WITH METAL OXIDES

BACKGROUND OF THE INVENTION

This invention is generally directed to toner and developer compositions, and more specifically the present invention is directed to processes for eliminating, or minimizing toner deposition, or toner sticking to, for example, electrophotographic, especially xerographic, components like wires, such as those illustrated in U.S. Pat. No. 4,868,600, the disclosure of which is totally incorporated herein by reference. In one embodiment, the process comprises utilizing toner compositions with conductive oxides, especially metal oxides, like tin oxide and titanium oxide. A specific embodiment of the present invention comprises adding a toner comprised of resin particles, pigment particles, a charge enhancing additive, and effective surface additives, such as conductive metal oxides, to a donor roll from a toner supply source, transporting the toner to a development nip situated between an imaging member and the donor roll, and wherein there are present wires, usually two, self spaced above the donor roll, application of an AC field to the wires thereby generating a toner cloud, and development of latent images present on the imaging member by the attraction of toner particles to said image and whereby the undesirable dynamic sticking of toner particles to the wires is avoided or minimized. The aforementioned sticking can cause the development of the images to fail through the formation of large agglomerates of toner particles. These in turn can cause imperfections and vacancies in the toner cloud leading to insufficient development on the image bearing member. This shows up as undesirable streaks on the final developed copies.

The process of the present invention is particularly useful for the scavengeless development apparatus illustrated in U.S. Pat. No. 4,868,600, the disclosure of which is totally incorporated herein by reference. Toner and controlled toner powder cloud are mentioned in this patent. Also, the process of the present invention can in embodiments be selected for the scavengeless development apparatus as illustrated in U.S. Pat. No. 5,032,872, issued Jul. 16, 1991, and U.S. Ser. No. 396,153 , the disclosures of which are totally incorporated herein by reference.

In a patentability search report, the following U.S. Pat. Nos. are listed: 4,868,600, discussed herein; 4,837,100, which discloses a positively charged developer with toner particles containing fine particles of hydrophobic alumina and fine particles of, for example, tin oxide or titanium dioxide, reference the Abstract; apparently the developer "hardly" undergoes toner cloud or toner dropping during development, and this developer produces a high quality image, see column 1 for example; 4,873,185, which discloses a toner which is capable of eliminating tailing, see column 2; the toner contains a certain metal complex compound, and a metal complex salt-type monazo dye having a hydrophilic group; 4,871,616, discloses a surface treated poly methyl silsesquioxane powder characterized by surface treatment with an agent comprising a compound which has at least two radicals attached to a metal atom, or a silicon atom, see the Abstract for example; examples of metal atoms in the surface treating agent include titanium, and tin, see columns 3 and 4; 4,933,251, which discloses a developer with a toner containing, for example, a layer of external additives of fine metal oxides, fine silica particles, and cleaning aid particles, see the Abstract; also see columns 1 and 2, wherein in column 2 it is indicated that there is a greatly decreased tendency for the toner to become attached to nonimage areas; 4,973,540, which discloses a toner with an inorganic fine particle with at least both a negatively and positively chargeable polar group on the surface of the inorganic fine particles, see the Abstract; examples of inorganic fine particles include titanium dioxide, see column 3; and 3,888,678, which discloses treating the surface of toners with a charge control agent; the above patentability search report indicates that the agent used to treat the surface of the particles is comprised of metal oxides, such as titanium dioxide, or tin oxide; however, this teaching cannot be located in the '678 patent.

Toner and developer compositions containing charge enhancing additives, especially additives which impart a positive charge to the toner resin, are well known. Thus, for example, there is described in U.S. Pat. No. 3,893,935 the use of certain quaternary ammonium salts as charge control agents for electrostatic toner compositions. There are also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there are illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride.

Other prior art disclosing positively charged toner compositions with charge enhancing additives include U.S. Pat. Nos. 3,944,493; 4,007,293; 4,079,014 and 4,394,430.

SUMMARY OF THE INVENTION

It is a feature of the present invention to provide processes which possess the advantages illustrated herein in embodiments.

Another feature of the present invention resides in the provision of processes wherein the sticking of toner particles to wires in scavengeless development systems is avoided or minimized.

A feature of the present invention resides in the provision of processes wherein there are selected toners with metal oxides, thereby reducing nip wire contamination in scavengeless development, including hybrid scavengeless development as illustrated in copending patent applications U.S. Ser. No. 429,108, and U.S. Ser. No. 396,153, the disclosures of each being totally incorporated herein by reference, wherein toner and carrier are contained in the developer supply means. More specifically, there is disclosed in U.S. Pat. No. 5,032,872, an apparatus for developing a latent image recorded on a movable surface, including a reservoir for storing developer material comprising at least carrier and toner; a plurality of donor members spaced apart from each other in the direction of movement of the surface, and a common transport member arranged to transport developer material from said reservoir and to supply toner therefrom to at least said plurality of donor members for delivery to the surface to develop the latent image recorded thereon, and in an embodiment wherein each one of said plurality of donor rolls forms, with said magnetic brush roll, a respective loading nip at which toner can be loaded onto each one of said plurality of donor rolls from the magnetic brush roll. In copending patent application U.S. Ser. No. 396,153, there is disclosed an apparatus for developing a latent image recorded on a surface, including:

a housing defining a chamber storing a supply of developer material comprising at least carrier and toner;

a donor member spaced from the surface and being adapted to transport toner to a region opposed from the surface;

means for advancing developer material in the chamber of said housing, said advancing means and said donor member cooperating with one another to define a region wherein a substantially constant quantity of toner having a substantially constant triboelectric charge is deposited on said donor member; and an electrode member positioned in the space between the surface and said donor member, said electrode member being closely spaced from said donor member and being electrically biased to detach toner from said donor member so as to form a toner cloud in the space between said electrode member and the surface with detached toner from the toner cloud developing the latent image.

These and other features of the present invention can be accomplished in embodiments by processes wherein there are selected toners with metal oxides. More specifically, the present invention is directed to a process which comprises the utilization of toners with metal oxides for the scavengeless development apparatus as illustrated in U.S. Pat. No. 4,868,600, and the copending patent applications mentioned herein, the disclosures of which are totally incorporated herein by reference.

In one embodiment, the process of the present invention comprises providing an apparatus for developing latent electrostatic images on a charge retentive surface with toner comprised of resin particles, pigment particles, charge additive particles and metal oxide particles, and wherein the apparatus comprises a toner supply, a donor structure spaced from the charge retentive surface for conveying toner from the supply to an area opposite the retentive surface; an electrode structure, which can be comprised of two tungsten wires separated by about 1 millimeter; means for establishing an alternating electrostatic field between the donor and electrode structures; the electrode structure being positioned in a space between the charge retentive surface and the donor structure and in sufficiently close proximity to the donor to permit the detachment of toner therefrom with high alternating electrostatic fields; and the attraction of toner to the latent image by, for example, creating an electrostatic field between the retentive surface and the electrode structure, whereby toner sticking and toner contamination of the wires is avoided or minimized.

Illustrative examples of suitable toner resins selected for the toner and developer compositions of the present invention, and present in various effective amounts such as, for example, from about 70 percent by weight to about 95 percent by weight, include polyesters, polyamides, epoxy resins, polyurethanes, polyolefins, styrene acrylates, styrene methacrylates, styrene butadienes, vinyl resins and polymeric esterification products of a dicarboxylic acid and a diol comprising a diphenol. Various suitable resins may be selected as the toner resin including homopolymers or copolymers of two or more vinyl monomers. Examples of monomers include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, and butyl methacrylate; acrylonitrile, methacrylonitrile, acrylamide; vinyl ester such as vinyl methyl ether, vinyl isobutyl ether, and vinyl ethyl ether; N-vinyl indole; N-vinyl pyrrolidone; and the like. Specific examples of toner resins include styrene butadiene copolymers, especially styrene butadiene copolymers prepared by a suspension polymerization process reference, U.S. Pat. No. 4,558,108, the disclosure of which is totally incorporated herein by reference; PLIOLITES®, PLIOTONES® available from Goodyear Chemical Company; and mixtures thereof.

As one toner resin there can be selected the esterification products of a dicarboxylic acid and a diol comprising a diphenol, which components are illustrated in U.S. Pat. No. 3,590,000, the disclosure of which is totally incorporated herein by reference. Other toner resins include styrene/methacrylate copolymers, styrene/acrylate copolymers, and styrene/butadiene copolymers, especially those as illustrated in the aforementioned patent; and styrene butadiene resins with high styrene content, that is exceeding from about 80 to 85 percent by weight of styrene, which resins are available as PLIOLITES® from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol.

Numerous well known suitable pigments can be selected as the colorant for the toner particles including, for example, carbon black, such as REGAL 330® available from Cabot Corporation, nigrosine dye, aniline blue, phthalocyanine derivatives, magnetites and mixtures thereof. The pigment should be present in a sufficient amount to render the toner composition colored thereby permitting the formation of a clearly visible image. Generally, the pigment particles are present in effective amounts of, for example, from about 2 percent by weight to about 20, and preferably about 10 percent by weight, based on the total weight of the toner composition, however, lesser or greater amounts of pigment particles may be selected.

When the pigment particles are comprised of magnetites, including those commercially available as MAPICO BLACK®, they are present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures for example contain from about 6 percent to about 70 percent by weight of magnetite, and from about 2 percent to about 15 percent by weight of carbon black.

Conductive metal oxides usually present as surface additives in effective amounts of, for example, from between about 0.1 to about 10 weight percent, and preferably from between about 0.2 to 2 weight percent include tin oxides, such as S-1 available from Mitsubishi Chemical with an average size between 0.1 and 0.5 micron and a typical conductivity of $2.4\times10^{-6}$ (ohm-cm)$^{-1}$ or tin oxide available from the Tioxide Corporation with an average size between 10 and 30 millimicrons and a conductivity of $10^{-7}$ (ohm-cm)$^{-1}$. Conductive titanium oxides suitable for the present invention include P-25 available from Degussa Corporation with an average particle size between 20 and 40 microns and a conductivity of $1.3\times10^{-6}$ (ohm-cm)$^{-1}$, T805, P25 treated with trimethoxyoctylsilane with the same particle size as P25 but a conductivity of $3.6\times10^{-4}$ (ohm-cm)$^{-1}$, and the like. Pigment grade zinc oxides with typical sizes of about 80 millimicrons and conductivities of $2.7\times10^{-3}$ (ohm-cm)$^{-1}$ are also suitable. Aluminum oxides such as Aluminum Oxide C with a typical particle size of 20 millimicrons and a conductivity of $2.9\times10^{-7}$ (ohm-cm)$^{-1}$ available from Degussa Corporation is also suitable. In general, any conductive metal oxide with a particle size below 1 micron and a conductivity greater than $10^{-10}$ (ohm-cm)$^{-1}$ may be suitable in embodiments of the present invention.

Also embraced within the scope of the present invention are the use of colored toner compositions containing as pigments or colorants magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the color index as CI 60710, CI Dispersed Red 15, a diazo dye identified in the Color Index as CI 26050, CI Solvent Red 10, Lithol Scarlett, Hostaperm, and the like. Illustrative examples of cyan materials that may be used as pigments include copper tetra-4(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, Sudan Blue, and the like; while illustrative examples of yellow pigments that may be selected include diarylide yellow 3,3-dichlorobenzidene acetoacetanilides, a monazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. These pigments are generally present in the toner composition in an amount of from about 2 weight percent to about 15 weight percent based on the weight of the toner resin particles.

Illustrative examples of charge enhancing additives present in various effective amounts, such as for example from about 0.1 to about 20, and preferably from about 0.1 to about 3 percent by weight, include alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; potassium tetraphenylborate and other tetraphenylborate salts; metal salts of salicylic acid and their derivatives, BONTRON E-84 TM, and BONTRON E-88 TM, available from Hodagaya Chemicals of Japan, and other known similar charge enhancing additives.

With further respect to the toner compositions selected for the processes of the present invention, there can be added thereto a linear polymeric alcohol comprised of a fully saturated hydrocarbon backbone with at least about 80 percent of the polymeric chains terminated at one chain end with a hydroxyl group, which alcohol is represented by the following formula:

$$CH_3(CH_2)_nCH_2OH$$

wherein n is a number of from about 30 to about 300, and preferably of from about 30 to about 100, which alcohols are available from Petrolite Corporation. Particularly preferred polymeric alcohols include those wherein n represents a number of from about 30 to about 50. Therefore, in an embodiment of the present invention the polymeric alcohols selected have a number average molecular weight as determined by gas chromatography of from about greater than 450 to about 1,400, and preferably of from about 475 to about 750. In addition, the aforementioned polymeric alcohols are present in the toner and developer compositions illustrated herein in various effective amounts, and can be added as uniformly dispersed internal, or as finely divided uniformly dispersed external additives. More specifically, the polymeric alcohols are present in an amount of from about 0.05 percent to about 20 percent by weight. Therefore, for example, as internal additives the polymeric alcohols are present in an amount of from about 0.5 percent by weight to about 20 percent by weight, while as external additives the polymeric alcohols are present in an amount of from about 0.05 percent by weight to slightly less than about 5 percent by weight. Toner and developer compositions with the waxes present internally are formulated by initially blending the toner resin particles, pigment particles, and polymeric alcohols, and other components. In contrast, when the polymeric alcohols are present as external additives, the toner composition is initially formulated comprised of, for example, resin particles, pigment particles, and the other components illustrated herein; and subsequently there is added thereto finely divided polymeric alcohols.

Illustrative examples of carrier particles that can be selected for mixing with the toner compositions in the toner supply means include those particles that are capable of triboelectrically obtaining a charge of opposite polarity to that of the toner particles. Accordingly, the carrier particles of the present invention can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of carrier particles that may be selected include granular zircon, granular silicon, glass, steel, nickel, iron, ferrites, such as copper zinc manganese, silicon dioxide, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Carrier particles selected in embodiments are comprised of a magnetic, such as steel, core with a polymeric coating thereover several of which are illustrated, for example, in U.S. Ser. No. 751,922, now abandoned, relating to developer compositions with certain carrier particles, the disclosure of which is totally incorporated herein by reference. More specifically, there are illustrated in the aforementioned abandoned application carrier particles comprised of a core with a coating thereover of vinyl polymers, or vinyl homopolymers. Examples of specific carriers illustrated in the copending application, and useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidene fluoride resins, polymethylmethacrylate, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride; and trichlorofluoroethylene; and other known coatings. There can also be selected as carriers components comprised of a core with a polymer coating mixture thereover, reference U.S. Pat. Nos. 4,937,166, and 4,935,326, the disclosures of which are totally incorporated herein by reference. More specifically, there are detailed in these patents carrier particles with substantially stable conductivity parameters prepared by a process which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles about and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 20 microns to about 200 microns, thus allowing these particles to possess sufficient density and inertia to avoid adherence to the electrostatic images during the development process. The carrier particles can be mixed with the toner particles in various suitable combinations, such as for example from about 1 to about 5 parts toner to about 100 to about 300 parts by weight of carrier.

The toner compositions of the present invention can be prepared by a number of known methods, including mechanical blending and melt blending the toner resin particles, pigment particles or colorants, and charge additives followed by mechanical attrition, including classification to enable toner particles with an average diameter of from about 10 to about 20 microns. Thereafter, the metal oxides can be added to the toner as surface additives in a known blending apparatus. More specifically, the metal oxides can be added by blending in apparatus such as the Lightnin' Labmaster blender, the Lodige blender, or a Henschel blender. Another blending method is accomplished mixing the toner and metal oxides with steel, glass, ceramic or other suitable beads, mixing on a roll mill and subsequently screening out the beads. Other methods include those well known in the art such as spray drying, mechanical dispersion, extrusion, melt dispersion, dispersion polymerization, and suspension polymerization.

Examples of photoreceptors with the latent image thereon and to which the toner can be attracted include known layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, titanyl phthalocyanines, and vanadyl phthalocyanines, while examples of charge transport layers include the aryl amines as disclosed in U.S. Pat. No. 4,265,990.

The following examples are being submitted to further define various species of the present invention. These examples are intended to illustrate and not limit the scope of the present invention. Also, parts and percentages are by weight unless otherwise indicated. Comparative Examples are also presented.

COMPARATIVE EXAMPLE I

A toner comprised of 10 percent of REGAL 330® carbon black, 1 percent of tetraphenyl borate charge control additive, and 89 percent of styrene butadiene (89/11) was blended with 0.5 percent of AEROSIL R812® fumed silica, which had been treated with 10 percent of dimethyl distearyl ammonium methyl sulfate (DDAMS). The blending was performed for 15 minutes in a Lightnin' Labmaster II blender.

The charge level of the resultant toner on the donor roll of the scavengeless imaging apparatus illustrated in U.S. Pat. No. 5,032,872, issued Jul. 16, 1991, the disclosure of which is totally incorporated herein by reference, was measured by vacuuming the toner into a filter device capable of capturing the toner enclosed in a conductive holder. The holder was connected to ground through an electrometer, which reads the charge on the toner deposited in the filter device. The mass of the captured toner can be determined by weighing the filter device before and after the capture of the toner. By dividing the captured charge by the captured mass, the charge to mass ratio of the captured toner originally on the donor roll can be determined. Initially, this was $-25$ μc/gram which later stabilized at $-20$ μc/gram. After 50 prints (developed images) with a layered imaging member with an aluminum substrate, a photogenerating layer of trigonal selenium in contact therewith, and a hole transport layer comprised of about 55 percent of an aryl amine, and 45 percent by weight of MAKROLON® polycarbonate, reference for example U.S. Pat. No. 4,265,990, the disclosure of which is totally incorporated herein by reference, 15 streaks per centimeter were observed on each of the prints. This was regarded as a very high undesirable level of streaking.

EXAMPLE I

The base toner of Comparative Example I was again blended with the same treated silica in the Labmaster for 15 minutes, but in addition 0.8 percent of S-1 tin oxide obtained from Mitsubishi Chemical was added to the mixture at the same time.

The resultant toner initially provided a charge level on the donor roll of −22 μc/gram when measured by the method described in Comparative Example I. This charge level later stabilized at −21 μc/gram. After 50 prints, no streaks were observed on the developed copies generated.

EXAMPLE II

The base toner of Comparative Example I was again blended with the same treated silica in the Labmaster for 15 minutes, but in addition 0.8 percent of P-25 titanium dioxide obtained from Degussa Corporation was added to the mixture at the same time.

The resultant toner initially provided a charge level on the donor roll of −21 μc/gram when measured by the method described in Comparative Example I. The charge level later stabilized at −20 μc/gram. No streaks were initially observed on the developed copy; about 2 streaks per centimeter were observed on the copies after 50 prints. This is regarded as a moderate level of streaking and is a considerable improvement over the very high level of streaking of Comparative Example I.

COMPARATIVE EXAMPLE II

The base toner of Comparative Example I was blended with 0.5 percent of AEROSIL R812® fumed silica, which had been treated with 15 percent of dimethyl distearyl ammonium methyl sulfate (DDAMS). The blending was performed for 15 minutes in a Lightnin' Labmaster II blender.

The resultant toner initially provided a charge level on the donor roll of −24 μc/gram when measured by the method described in Comparative Example I. The charge level later stabilized at −16 μc/gram. No streaks were initially observed on the developed copy, but after 50 prints a moderate level of streaking (~2/centimeter) was observed.

EXAMPLE III

The base toner of Comparative Example II was again blended with the same treated silica in the Labmaster for 15 minutes, but in addition 0.2 percent of P-25 titanium dioxide obtained from the Degussa Corporation was added to the mixture at the same time.

The resultant toner initially provided a charge level on the donor roll of −20 μc/gram when measured by the method described in Comparative Example I. The charge level later stabilized at −16 μc/gram. About 1 streak per centimeter was observed after 50 prints. This is regarded as a low level of streaking. Thus 0.2 percent of P-25 provided an improvement over Comparative Example II.

EXAMPLE IV

The base toner of Comparative Example II was again blended with the same treated silica in the Labmaster for 15 minutes, but in addition 0.8 percent of P-25 titanium dioxide obtained from the Degussa Corporation was added to the mixture at the same time.

The resultant toner initially provided a charge level on the donor roll of −15 μc/gram when measured by the method described in Comparative Example I. The charge level later stabilized at −13 μc/gram. No streaks were observed for any of 50 prints.

COMPARATIVE EXAMPLE III

The base toner of Comparative Example I was blended with 0.5 percent of AEROSIL R812® fumed silica, which had been treated with 20 percent of dimethyl distearyl ammonium methyl sulfate (DDAMS). The blending was performed for 15 minutes in a Lightnin' Labmaster II blender.

The resultant toner initially provided a charge level on the donor roll of −19 μc/gram when measured by the method described in Comparative Example I. The charge level later stabilized at −20 μc/gram. The level of streaking for the developed images was about 4/centimeter, which is regarded as medium.

EXAMPLE V

The base toner of Comparative Example III was again blended with the same treated silica in the Labmaster for 15 minutes, but in addition 0.8 percent of P-25 titanium dioxide obtained from the Degussa Corporation was added to the mixture at the same time.

The resultant toner initially provided a charge level on the donor roll of −19 μc/gram when measured by the method described in Comparative Example I. The charge level later stabilized at −15 μc/gram. No streaks were observed in any of 50 prints.

EXAMPLE VI

A base toner comprised of 0.3 percent of copper phthalocyanine, SUMIKAPRINT® Cyanine Blue GN-O obtained from Sumika, and listed in the Color Index as CI 74160, 1 percent of potassium tetraphenyl borate (KTPB) charge control additive, and 96 percent of styrene n-butyl methacrylate was blended with 0.6 percent of AEROSIL R812® fumed silica, which had been treated with 10 percent of dimethyl distearyl ammonium methyl sulfate (DDAMS) and 1 percent of P-25 titanium dioxide obtained from the Degussa Corporation. The blending was performed for 15 minutes in a Lightnin' Labmaster II blender.

The resultant toner provided a charge level on the donor roll of −20 μc/gram when measured by the method described in Comparative Example I. No streaks were observed in any of 50 prints.

EXAMPLE VII

A base toner consisting of 3 percent of magenta, SUMIKAPRINT® Carmine 6BC listed in the Color Index as CI 15850-1, 0.5 percent of potassium tetraphenyl borate (KTPB) charge control additive, and 96.5 percent of styrene n-butyl methacrylate was blended with 0.6 percent of AEROSIL R812® fumed silica, which had been treated with 5 percent of dimethyl distearyl ammonium methyl sulfate (DDAMS) and 1 percent of P-25 titanium dioxide obtained from the Degussa Corporation. The blending was performed for 15 minutes in a Lightnin' Labmaster II blender.

The resultant toner provided a charge level on the donor roll of −24 μc/gram when measured by the method described in Comparative Example I. No streaking was observed in 50 prints.

EXAMPLE VIII

A base toner comprised of 3 percent of yellow, SUMIKAPRINT® Yellow ST-O listed in the Color Index as CI 21090, 0.5 percent of potassium tetraphenyl borate (KTPB) charge control additive, and 96.5 percent of styrene n-butyl methacrylate was blended with 0.6 percent of AEROSIL R812® fumed silica, which had been treated with 10 percent of dimethyl distearyl ammonium methyl sulfate (DDAMS) and 1 percent of P-25 titanium dioxide from the Degussa Corporation. The blending was performed for 15 minutes in a Lightnin' Labmaster II blender.

The resultant toner provided a charge level on the donor roll of −9 μc/gram when measured by the method described in Comparative Example I. No streaking was observed in 50 prints.

EXAMPLE IX

A base toner comprised of 3 percent of copper phthalocyanine, SUMIKAPRINT® Cyanine Blue GN-O from Sumika listed in the Color Index as CI 74160, 1 percent of potassium tetraphenyl borate (KTPB) charge control additive, and 96 percent of styrene n-butyl methacrylate was blended with 0.6 percent of AEROSIL R812® fumed silica and 0.2 percent of P-25 titanium dioxide obtained from the Degussa Corporation. The blending was performed for 15 minutes in a Lightnin' Labmaster II blender.

The resultant toner had a charge level on the donor roll of −25 μc/gram when measured by the method described in Comparative Example I. No streaking was observed in 50 prints.

EXAMPLE X

A toner comprised of 3 percent of magenta, SUMIKAPRINT® Carmine 6BC listed in the Color Index as CI 15850-1, 0.5 percent of potassium tetraphenyl borate (KTPB) charge control additive, and 96.5 percent of styrene n-butyl methacrylate was blended with 0.6 percent of AEROSIL R812® fumed silica and 2 percent of P-25 titanium dioxide from the Degussa Corporation. The blending was performed for 15 minutes in a Lightnin' Labmaster II blender.

The resultant toner had a charge level on the donor roll of −27 μc/gram when measured by the method described in Comparative Example I. No streaking was observed in 1,000 prints.

EXAMPLE XI

A toner of 3 percent of yellow, SUMIKAPRINT® Yellow ST-O listed in the Color Index as CI 21090, 0.5 percent of potassium tetraphenyl borate (KTPB) charge control additive, and 96.5 percent of styrene n-butyl methacrylate was blended with 0.6 percent of AEROSIL R812® fumed silica and 2 percent of P-25 titanium dioxide from the Degussa Corporation. The blending was performed for 15 minutes in a Lightnin' Labmaster II blender.

The resultant toner had a charge level on the donor roll of −33 μc/gram when measured by the method described in Comparative Example I. No streaking was observed in 100 prints.

EXAMPLE XII

A toner comprised of 5 percent of copper phthalocyanine, SUMIKAPRINT® Cyanine Blue GN-O from Sumika listed in the Color Index as CI 74160, 1 percent of potassium tetraphenyl borate (KTPB) charge control additive, and 94 percent of styrene n-butyl methacrylate was blended with 0.6 percent of AEROSIL R812® fumed silica and 2 percent of P-25 titanium dioxide from the Degussa Corporation. The blending was performed for 15 minutes in a Lightnin' Labmaster II blender.

The resultant toner had a charge level on the donor roll of −33 μc/gram when measured by the method described in Comparative Example I. No streaking was observed in 1,000 prints.

EXAMPLE XIII

A toner comprised of 5 percent of magenta, SUMIKAPRINT® Carmine 6BC listed in the Color Index as CI 15850-1, 0.5 percent of potassium tetraphenyl borate (KTPB) charge control additive, and 94.5 percent of styrene n-butyl methacrylate was blended with 0.6 percent of AEROSIL R812® fumed silica and 2 percent of P-25 titanium dioxide obtained from the Degussa Corporation. The blending was performed for 15 minutes in a Lightnin' Labmaster II blender.

The resultant toner provided a charge level on the donor roll of −30 μc/gram when measured by the method described in Comparative Example I. No streaking was observed in 1,000 prints.

EXAMPLE XIV

A toner of 5 percent of yellow, SUMIKAPRINT® Yellow ST-O listed in the Color Index as CI 21090, 0.5 percent of potassium tetraphenyl borate (KTPB) charge control additive, and 94.5 percent of styrene n-butyl methacrylate was blended with 0.6 percent of AEROSIL R812® fumed silica and 2 percent of P-25 titanium dioxide from the Degussa Corporation. The blending was performed for 15 minutes in a Lightnin' Labmaster II blender. No streaking was observed in 1,000 prints.

Other modifications of the present invention may occur to those skilled in the art subsequent to a review of the present application. The aforementioned modifications, including equivalents thereof, are intended to be included within the scope of the present invention.

What is claimed is:

1. A process for avoiding, or minimizing toner contamination of electrodes in a scavengeless electrophotographic imaging apparatus consisting essentially of adding to the donor roll present in said apparatus toner particles comprised of resin, pigment, charge additive, and metal oxide particles, or a mixture of metal oxide particles, and wherein said metal oxide particles are associated with the surface of said toner particles.

2. A process in accordance with claim 1 wherein the metal oxide is present as a toner surface additive.

3. A process in accordance with claim 1 wherein the metal oxide is selected from the group consisting of tin oxide, titanium oxide, and mixtures thereof.

4. A process in accordance with claim 1 wherein the charge additive is a positive or negative charge control agent.

5. A process in accordance with claim 1 wherein the charge additive is a metal salt of tetraphenyl borate, a metal salt of salicylic acid, dimethyl distearyl ammonium methyl sulfate, or cetyl pyridinium chloride.

6. A process in accordance with claim 1 wherein the resin is a styrene acrylate, a styrene methacrylate, a styrene butadiene or a polyester.

7. A process in accordance with claim 1 wherein the pigment is carbon black or a color pigment other than carbon black.

8. A process in accordance with claim 1 wherein the amount of metal oxide surface additive is from about 0.2 to about 5 weight percent, the amount of charge control additive is from about 0.1 to about 5 weight percent, the amount of resin is from about 75 to about 99 weight percent, and the amount of pigment is from about 1 to about 15 weight percent.

* * * * *